US008847477B2

(12) United States Patent
Kawashima et al.

(10) Patent No.: US 8,847,477 B2
(45) Date of Patent: Sep. 30, 2014

(54) LIGHT-EMITTING CIRCUIT AND LUMINAIRE

(71) Applicant: Toshiba Lighting & Technology Corporation, Kanagawa-ken (JP)

(72) Inventors: Seiko Kawashima, Kanagawa-ken (JP); Yoshiko Takahashi, Kanagawa-ken (JP); Masahiro Fujita, Kanagawa-ken (JP); Takahito Kashiwagi, Kanagawa-ken (JP)

(73) Assignee: Toshiba Lighting & Technology Corporation, Kanagawa (JP)

( * ) Notice: Subject to any disclaimer, the term of this patent is extended or adjusted under 35 U.S.C. 154(b) by 0 days.

(21) Appl. No.: 13/828,807

(22) Filed: Mar. 14, 2013

(65) Prior Publication Data

US 2014/0232259 A1 Aug. 21, 2014

(30) Foreign Application Priority Data

Feb. 20, 2013 (JP) ..... 2013-031191

(51) Int. Cl.
*H05B 33/12* (2006.01)

(52) U.S. Cl.
CPC ..... *H05B 33/12* (2013.01)
USPC ..... 313/498; 257/98; 362/84

(58) Field of Classification Search
USPC ..... 313/498, 512; 257/98; 362/84
See application file for complete search history.

(56) References Cited

U.S. PATENT DOCUMENTS

| | | | | |
|---|---|---|---|---|
| 7,072,096 | B2 * | 7/2006 | Holman et al. | 359/298 |
| 2004/0223315 | A1 * | 11/2004 | Suehiro et al. | 362/84 |
| 2005/0077532 | A1 * | 4/2005 | Ota et al. | 257/98 |
| 2009/0140630 | A1 * | 6/2009 | Kijima et al. | 313/498 |

OTHER PUBLICATIONS

Cree, Inc., Homepage, Internet: URL: http://www.cree.com/.

* cited by examiner

*Primary Examiner* — Mary Ellen Bowman
(74) *Attorney, Agent, or Firm* — Patterson & Sheridan, LLP

(57) ABSTRACT

According to one embodiment, a light-emitting circuit including a substrate, a plurality of light-emitting portions, and a luminous intensity distribution control member is provided. A plurality of the light-emitting portions are arranged apart from each other on the substrate. A plurality of the light-emitting portions each have a plurality of light-emitting elements and a color mixing unit. A plurality of the light-emitting elements radiate light. The color mixing unit combines the lights sealing a plurality of the light-emitting elements and radiated from a plurality of the light-emitting elements. The luminous intensity distribution control member includes a plurality of lenses provided corresponding to a plurality of the light-emitting portions, respectively, provided so that respective lights radiated from a plurality of the light-emitting portions enter a plurality of the lenses respectively, and configured to control the luminous intensity distribution of the light-emitting portions.

15 Claims, 9 Drawing Sheets

FIG. 6A
FIG. 6B
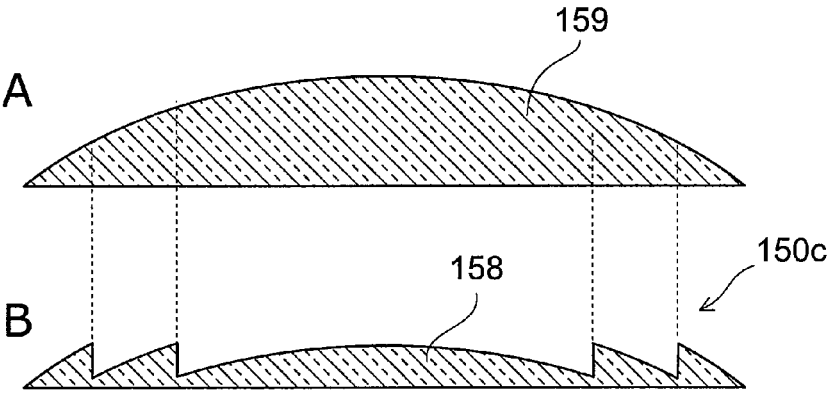
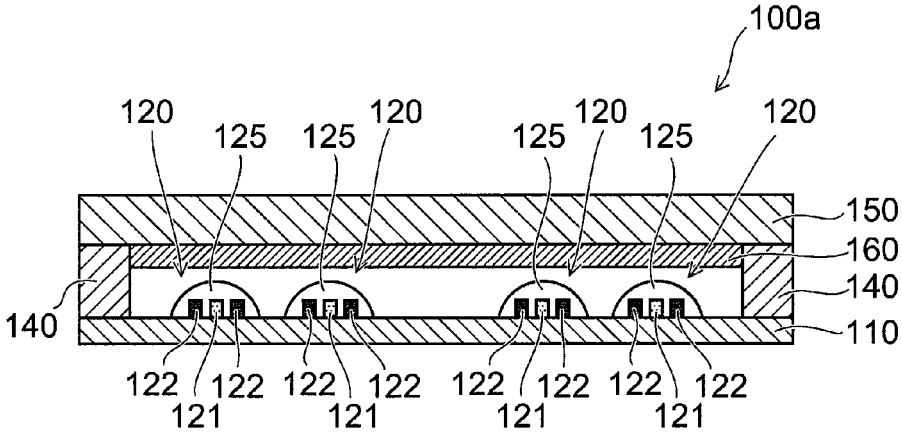
FIG. 7

| | COMPARATIVE EXAMPLE 1 | COMPARATIVE EXAMPLE 2 | EMBODIMENT 1 | EMBODIMENT 2 | EMBODIMENT 3 |
|---|---|---|---|---|---|
| LED CHIP | BLUE LED CHIP | BLUE LED CHIP RED LED CHIP | BLUE LED CHIP RED LED CHIP | BLUE LED CHIP RED LED CHIP | BLUE LED CHIP RED LED CHIP |
| PHOSPHOR | YELLOW+ RED PHOSPHOR | YELLOW PHOSPHOR | YELLOW PHOSPHOR | YELLOW PHOSPHOR | YELLOW PHOSPHOR |
| FORM OF INSTALLATION OF LIGHT-EMITTING PORTIONS | AGGREGATION | AGGREGATION | ARRANGEMENT APART FROM EACH OTHER | ARRANGEMENT APART FROM EACH OTHER | ARRANGEMENT APART FROM EACH OTHER |
| FORM OF INSTALLATION OF LED CHIPS | - | FIRST ARRANGEMENT (FIG. 2A) | FIRST ARRANGEMENT (FIG. 2A) | SECOND ARRANGEMENT (FIG. 2B) | THIRD ARRANGEMENT (FIG. 2C) |
| TOTAL FLUX | 70 % | 90 % | 100 % | 100 % | 100 % |
| COLOR BREAKUP | ◎ (NIL) | × (LARGE) | ○ (SMALL) | ◎ (NIL) | ◎ (NIL) |
| GENERAL EVALUATION | × | △ | ○ | ◎ | ◎ |

FIG. 10

LIGHT-EMITTING CIRCUIT AND LUMINAIRE

CROSS-REFERENCE TO RELATED APPLICATIONS

This application is based upon and claims the benefit of priority from the prior Japanese Patent Application No. 2013-031191, filed on Feb. 20, 2013; the entire contents of which are incorporated herein by reference.

FIELD

Embodiment described herein relates to a light-emitting circuit and a luminaire.

BACKGROUND

A light-emitting diode (LED) is used, for example, as backlights for liquid crystal displays, mobile phone sets, information terminals or indoor and outdoor advertisements. The application of the light-emitting diode is dramatically spreading in many areas. The light-emitting diode grabs the spotlight not only in the industrial field, but also for general luminaires owing to improvement in elongation of service life, reduction of power consumption, impact resistance, improvement of high-speed response, realization of high-purity display color and light and compact structure. The light-emitting circuit and the luminaire using the light-emitting diode are expected to have performances capable of improving color rendering properties and controlling luminous intensity distribution and suitable for high-output.

DESCRIPTION OF THE DRAWINGS

FIGS. 6A and 6B are schematic drawings illustrating still another concrete example of a luminous intensity distribution control member of the embodiment;

FIG. 7 is a schematic cross-sectional view illustrating a light-emitting circuit according to another embodiment;

FIG. 10 is a table showing an example of a result of a study conducted by the inventor.

DETAILED DESCRIPTION

Figure 1A:
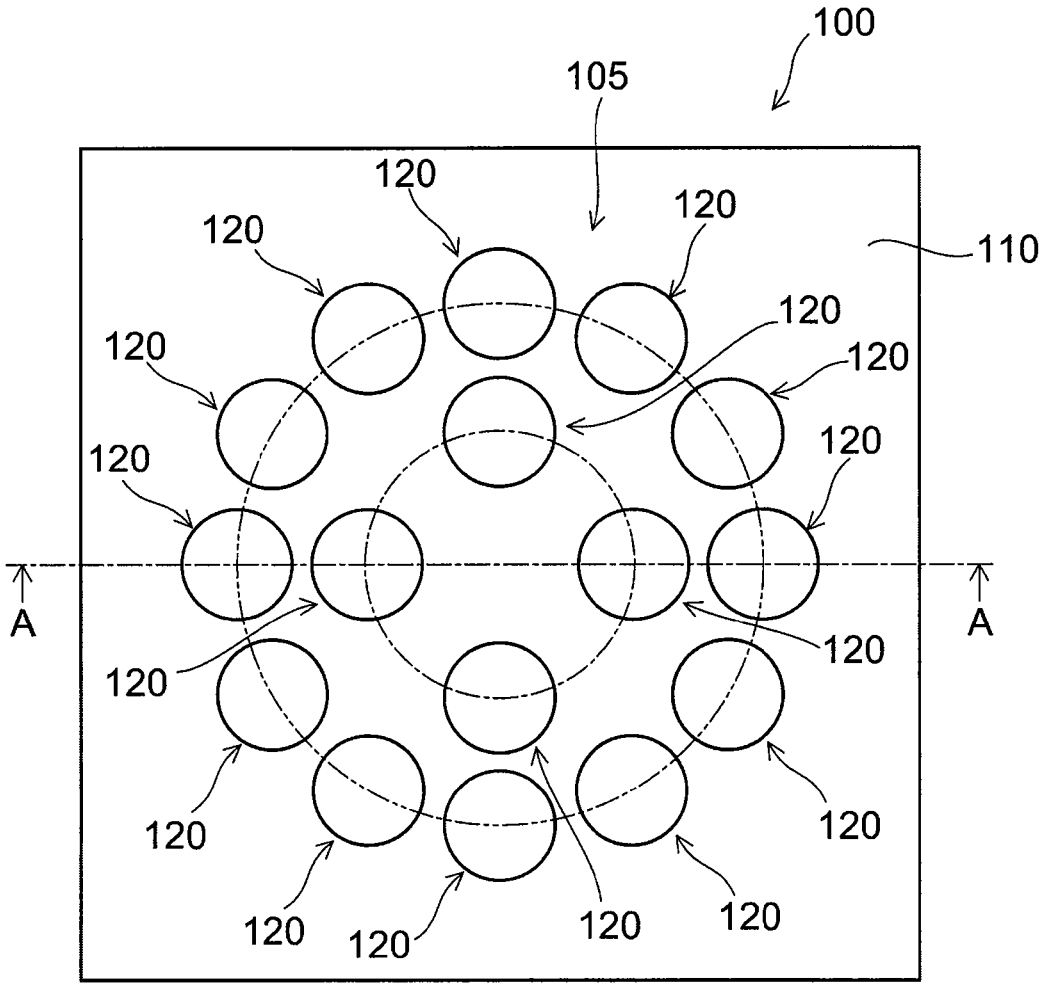
FIGS. 1A and 1B are schematic drawings illustrating a light-emitting circuit according to an embodiment.

A first aspect of the disclosure is a light-emitting circuit including a substrate; a plurality of light-emitting portions arranged apart from each other on the substrate, each of a plurality of the light-emitting portions including a plurality of light-emitting elements configured to radiate light, a color mixing unit configured to seal a plurality of the light-emitting elements and combine lights radiated from a plurality of the light-emitting elements; and a luminous intensity distribution control member including a plurality of lenses provided corresponding to a plurality of the light-emitting portions, respectively, provided so that respective lights radiated from a plurality of the light-emitting portions enter a plurality of the lenses respectively, and configured to control the luminous intensity distribution of the light-emitting portions.

In this configuration, the light may be radiate in a state in which the color unevenness is reduced, so that the color rendering properties may be improved. Also, the light-emitting circuit has performances capable of light control and suitable for the high-output.

Preferably, the light-emitting elements are semiconductor light-emitting elements containing a semiconductor material.

With the light-emitting circuit of this configuration, elongation of service life and reduction of power consumption are achieved.

Preferably, a plurality of the light-emitting elements include a first light-emitting element configured to radiate light in a first wavelength area; and a second light-emitting element configured to radiate light in a second wavelength area different from the first wavelength area, and the first light-emitting element and the second light-emitting element are sealed with the same color mixing unit.

With the light-emitting circuit of this configuration, radiation of lights of a plurality of colors instead of one-color is achieved.

Preferably, the first light-emitting element radiate blue light having peak wavelengths from 430 nanometer to 490 nanometer inclusive, and the second light-emitting element radiate red light having peak wavelengths from 600 nanometers to 670 nanometers inclusive.

With the light-emitting circuit of this configuration, lights of various colors may be radiated.

Preferably, the color mixing unit includes a phosphor configured to be excited by irradiated light from the first light-emitting element and radiate light in a third wavelength area different from the first wavelength area, and a scattering material and the light-emitting portion radiates light including irradiated light from the first light-emitting element, irradiated light from the second light-emitting element, and irradiated light from the phosphor combined together.

With the light-emitting circuit of this configuration, the light (for example, white light) including irradiated light from the first light-emitting element, irradiated light from the second light-emitting element, and irradiated light from the phosphor combined together may be radiated in a state in which color unevenness may further be reduced.

Preferably, the phosphor is a yellow phosphor configured to be excited by the irradiated light from the first light-emitting element, and irradiate light having a wavelength longer than 490 nanometers.

With the light-emitting circuit of this configuration, the light including irradiated light from the first light-emitting element, irradiated light from the second light-emitting element, and irradiated light from the yellow phosphor combined together may be radiated. When the first light-emitting element radiates the blue light and the second light-emitting element radiates the red right, white light may be radiated.

Preferably, the arrangement of a plurality of the light-emitting elements in the interior of the color mixing unit is the same for each of a plurality of the light-emitting portions.

Preferably, the horizontal and vertical ratio of the aggregation of a plurality of the light-emitting portions on the substrate is 10:1 or more and 1:1 or lower.

Preferably, a plurality of the light-emitting portions are arranged concentrically or pseudo-concentrically on the substrate.

Preferably, a plurality of the light-emitting portions are arranged linearly on the substrate.

According to the light-emitting circuit having any one of configurations described above, variations in color rendering properties in a plurality of the light-emitting portions may be reduced. In other words, while there is a case where variation in color rendering properties may occur depending on the angle of viewing the light-emitting portions, while the degrees of the color variations among a plurality of the light-emitting portions are the same in any angle when the light-emitting portions are viewed from the same angles.

Preferably, each of a plurality of the light-emitting portions is formed into a dome shape on the substrate.

With the light-emitting circuit of this configuration, the light may be radiated in a state in which a plurality of the light-emitting elements are reliably sealed, and the color unevenness is reduced.

Preferably, the circuit of the embodiment disclosed herein further includes a light-diffuser layer provided between the light-emitting portions and the luminous intensity distribution control member.

With the light-emitting circuit of this configuration, the light radiated from the light-emitting portions enter the light-diffuser layer before being radiated from the luminous intensity distribution control member to the outside. The light entering the light-diffuser layer is diffused by the light-diffuser layer, is passed through the luminous intensity distribution control member, and is radiated to the outside. Therefore, light may be radiated in a state in which the color unevenness is further reduced.

Preferably, the lens is a collimator lens.

With the light-emitting circuit of this configuration, light radiated from the luminous intensity distribution control member to the outside may be converted to parallel light beams.

Preferably, the luminous intensity distribution control member includes a fly-eye lens including a plurality of the lenses arranged vertically and horizontally.

With the light-emitting circuit of this configuration, the light may be radiated in a state in which the light intensity unevenness is reduced.

Preferably, the lens is a Fresnel lens.

With the light-emitting circuit of this configuration, the light may be radiated and the thickness of the luminous intensity distribution control member may be reduced in a state in which the color unevenness is further reduced.

There is also provided a luminaire including the light-emitting circuit according to the embodiments disclosed herein.

With the luminaire of this configuration, the light may be radiated in a state in which the color unevenness is reduced, and the color rendering properties may be improved. The luminaire of this configuration has performances capable of light control and suitable to a high-output.

Referring now to the drawings, embodiments disclosed herein will be described. In the respective drawings, the same components are designated by the same reference numerals and detailed description will be omitted as needed.

Figure 1B:
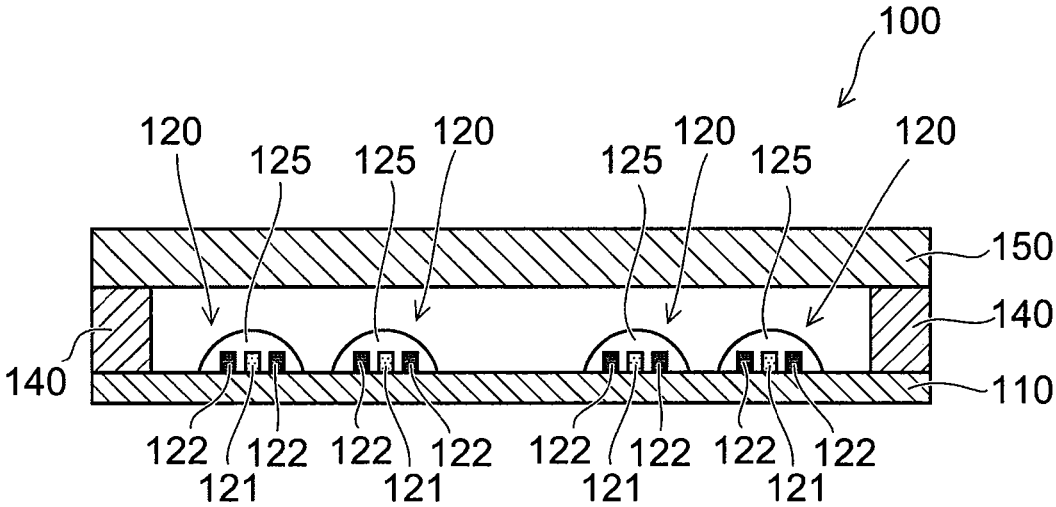

FIGS. 1A and 1B are schematic drawings illustrating a light-emitting circuit according to an embodiment.

Figure 2:
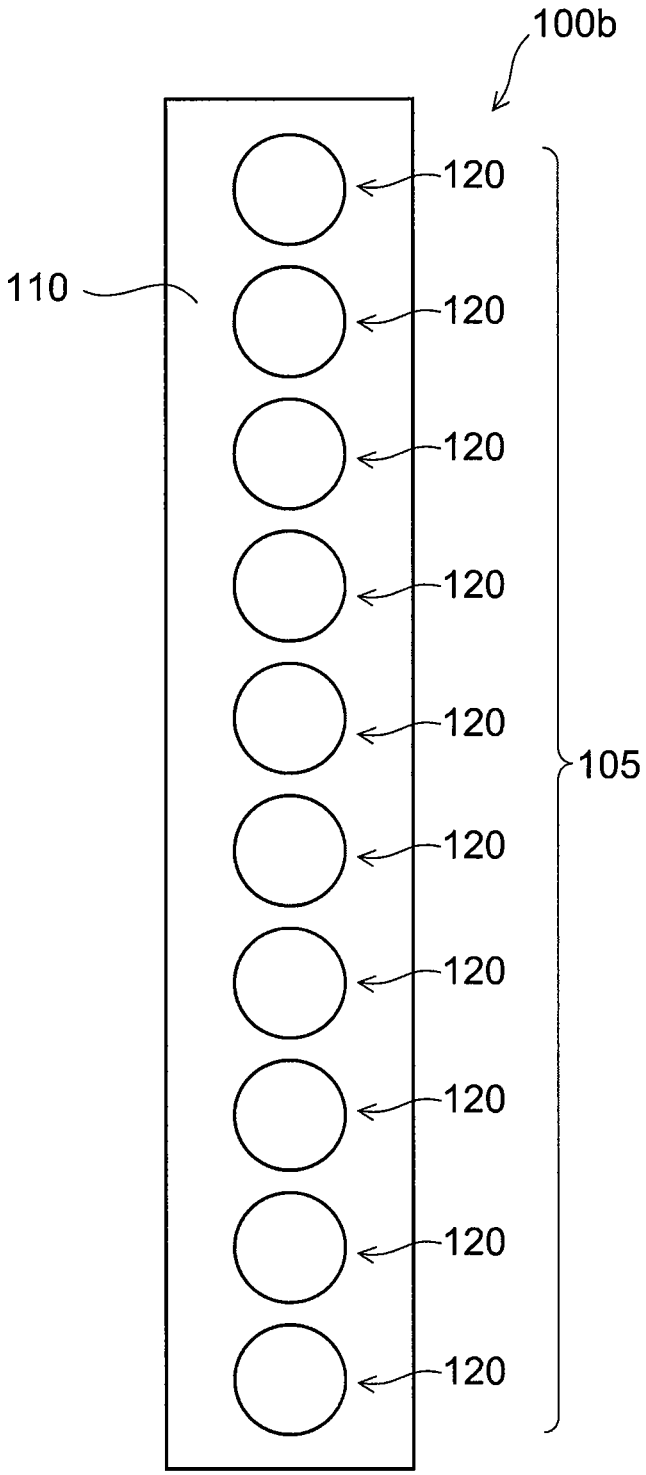
FIG. 2 is a schematic plan view illustrating other aspect ratio of light from a general light-emitting portion of the embodiment.

FIG. 2 is a schematic plan view illustrating other aspect ratio of light from a general light-emitting portion of the embodiment. FIG. 1A is a schematic plan view illustrating the light-emitting circuit according to the embodiment. FIG. 1B is a schematic cross-sectional view taken along a section A-A expressed in FIG. 1A. In FIG. 1A, a holding member 140 and a luminous intensity distribution control member 150 are omitted for the sake of convenience.

A light-emitting circuit 100 according to the embodiment includes a substrate 110, light-emitting portions 120, the holding member 140, and the luminous intensity distribution control member 150.

The substrate 110 is formed of, for example, a material containing at least one of a glass epoxy, a metal having relatively high thermal radiation properties, and a ceramic having relatively high reliability. When the substrate 110 is formed of a material containing ceramic, for example, a 96% alumina substrate is used.

The surface of the substrate 110 is provided with a wiring layer, not illustrated. The wiring layer is formed, for example, of electrolytic silver plating, or immersion silver plating. Alternatively, the wiring layer is formed of nickel (Ni) plating, palladium (Pd) plating, or gold (Au) plating. At this time, the nickel plating, the palladium plating and the gold plating are applied on a silver printing.

As illustrated in FIG. 1B, a plurality of light-emitting portions 120 are provided on the substrate 110 in the embodiment. In this specification, an aggregation of a plurality of the light-emitting portions 120 may be referred to as a "general light-emitting portion 105". As illustrated in FIG. 1A, a plurality of the light-emitting portions 120 are arranged concentrically or pseudo concentrically on the substrate 110. In other words, each of a plurality of the light-emitting portions 120 exists on a circle having a predetermined diameter on the substrate 110.

The general light-emitting portion 105 is not limited to have a concentric or pseudo concentric shape. For example, as a light-emitting circuit 100*b* illustrated in FIG. 2, a plurality of the light-emitting portions 120 may be arranged linearly on the substrate 110. The aspect ratio of the general light-emitting portion 105 of the substrate 110 illustrated in FIG. 1A is 1:1. In contrast, the aspect ratio of the general light-emitting portion 105 of the light-emitting circuit 100*b* illustrated in FIG. 2 is 10:1. However, the aspect ratio of the general light-emitting portion 105 of the embodiment is not limited thereto and, for example, may be 10:1 or more, and 1:1 or less.

In this specification, the term "aspect ratio" means horizontal to vertical ratio of a virtual area surrounding an outline of the general light-emitting portion 105.

As illustrated in FIG. 1B, the light-emitting portions 120 is formed into a substantially dome shape or a substantially semi-spherical shape. Therefore, when viewing the light-emitting portions 120 vertically with respect to the main surface of the substrate 110, the light-emitting portions 120 take on a substantially circular shape. When viewing the light-emitting portions 120 vertically with respect to the main surface of the substrate 110, the respective centers of a plurality of the light-emitting portions 120 (the centers of the circles) preferably exist in at least part of a circle having a predetermined diameter. The shape of the light-emitting portions 120 is not limited to the substantially dome shape or the substantially semi-spherical shape, and may be a square shape, for example.

The light-emitting portions 120 include a first light-emitting element 121, a second light-emitting element 122, and a color mixing unit 125. The first light-emitting elements 121 and the second light-emitting elements 122 are, respectively, semiconductor light-emitting elements containing semiconductor material. Specifically, the first light-emitting elements 121 and the second light-emitting elements 122 are, respectively, LED (Light Emitting Diode) chips.

In the embodiment, one of the first light-emitting elements 121 and the second light-emitting elements 122 is blue LED chips. In the following description, a case where the first light-emitting elements 121 are the blue LED chips is exemplified. The first light-emitting elements 121 each includes p-electrode and n-electrode, not illustrated. The p-electrode is electrically connected to a positive electrode, not illustrated, via a metal wire or the like for example. The n-electrode is electrically connected to a negative electrode via the metal wire or the like for example. The first light-emitting elements 121 receive supply of DC power via the positive electrode and the negative electrode, and radiate light in a blue wavelength area (first wavelength area). The blue wavelength area, being not determined unambiguously, is defined as a wavelength area not shorter than 430 nanometer (nm) but shorter than 490 nm in the embodiment. A light-emitting spectrum of the first light-emitting elements 121 has a peak wavelength in a range from a light wavelength of 430 nm to a light wavelength of 490 nm inclusive.

In the embodiment, the other one of the first light-emitting elements 121 and the second light-emitting elements 122 is red LED chips. In the following description, a case where the second light-emitting elements 122 are the red LED chips is exemplified. In the same manner as the first light-emitting elements 121, the p-electrode of each of the second light-emitting elements 122 is electrically connected to the positive electrode. The n-electrode of each of the second light-emitting elements 122 is electrically connected to the negative electrode. The second light-emitting elements 122 receive supply of DC power via the positive electrode and the negative electrode, and radiate light in a red wavelength area (second wavelength area). The red wavelength area is a wavelength area having a light wavelength of a range from a light wavelength of 600 nm to 670 nm inclusive. A light-emitting spectrum of the second light-emitting elements 122 has a peak wavelength in a range from a light wavelength of 600 nm to a light wavelength of 670 nm inclusive.

The color mixing unit 125 is formed of a resin containing phosphor. The phosphor is excited by irradiated light from the first light-emitting elements 121 and radiates light in an area having a longer wavelength than the blue wavelength area (third wavelength area). As illustrated in FIG. 1B, the first light-emitting elements 121 and the second light-emitting elements 122 are sealed by a resin (color mixing unit 125) containing a phosphor dispersed therein. Examples of the phosphor include, for example, yellow phosphor such as YAG phosphor (yttrium, aluminum, garnet phosphor). Accordingly, the phosphor contained in the color mixing unit 125 is excited by light radiated from the first light-emitting elements 121, and radiates light having a wavelength longer than 490 nm.

The color mixing unit 125 may be formed of resin further containing scattering material such as silica, for example. In this case, the first light-emitting elements 121 and the second light-emitting elements 122 are sealed by a resin (color mixing unit 125) in which a scattering material is further dispersed.

As a resin forming the color mixing unit 125, for example, silicone is used. For example, by supplying the substantially equivalent amounts of resin onto the substrate 110 by using a dispenser or the like, a plurality of the light-emitting portions 120 may be formed to have the substantially same shape as illustrated in FIGS. 1A and 1B.

The luminous intensity distribution control member 150 includes a lens unit and is held by the holding member 140. The lens unit is provided with a plurality of lenses. A plurality of the lenses are provided correspondingly to a plurality of the light-emitting portions 120 respectively. In other words, light radiated from one of the light-emitting portions 120 enters one of a plurality of the lenses. Light radiated from another one of the light-emitting portions 120 enters another one of a plurality of the lenses. In other words, a plurality of the light-emitting portions 120 have a relationship of one-to-one correspondence with a plurality of the lenses. In other words, light radiated from each of a plurality of the light-emitting portions 120 enters each of a plurality of the lenses. The number of the light-emitting portions 120 to be installed does not necessarily have to be the same number of the lenses to be installed. For example, a plurality of the light-emitting portions 120 may have a relationship of one-to-one correspondence with part of a plurality of the lenses. The lens unit will be described later.

A light-transmissive material (for example, optical glass or optical plastic) is used for the luminous intensity distribution control member 150. In other words, the luminous intensity distribution control member 150 has a light-transmissivity with respect to light radiated from the light-emitting portions 120. The luminous intensity distribution control member 150 is, for example, transparent.

In the embodiment, the term "light-transmissive material" or "light-transmitting material" is not limited to materials having a transmittance of 100 percent (%), and means materials having at least a transmittance more than zero for light having a wavelength of visible light.

The luminous intensity distribution control member 150 controls the luminous intensity distribution of the light-emitting portions 120 by a lens owned by the luminous intensity distribution control member 150 itself. In other words, in order to enhance the luminance at a predetermined position, the distribution of the light radiated from the light-emitting portions 120 into the space is required to be changed depending on the application for the light-emitting circuit 100 and the luminaire of the embodiment. Therefore, the distribution of the light radiated from the light-emitting portions 120 into the space is required to have a luminous intensity distribution angle to be narrow or wide by controlling the luminous intensity distribution of the light-emitting portions 120 freely for the light-emitting circuit 100 and the luminaire of the embodiment. In contrast, the luminous intensity distribution control member 150 controls the luminous intensity distribution of the light-emitting portions 120 by the lens owned by the luminous intensity distribution control member 150 itself. Accordingly, the light-emitting circuit 100 of the embodiment is capable of controlling the distribution of the irradiated light into the space.

However, the luminous intensity distribution control member 150 controls the luminous intensity distribution of the light-emitting portions 120 and, on the other hand, split the light radiated from the light-emitting portions 120 by the lens owned by the luminous intensity distribution control member 150 itself. Then, the spectrum of the light radiated from the light-emitting portions 120 becomes uneven, and color unevenness of the irradiated light may occur.

In contrast, in the embodiment, a plurality of the LED chips (different light-emitting chips) configured to radiate lights having colors different from each other (the lights in different wavelength areas) are sealed by the single semi-spherical color mixing unit 125. More specifically, the first light-emitting elements 121 radiate light in a wavelength area different from the wavelength area of the light radiated from the second light-emitting elements 122. The first light-emitting elements 121 and the second light-emitting elements 122 are sealed by the color mixing unit 125. A plurality of the light-emitting portions 120 are arranged apart from each other on the substrate 110. Therefore, lights radiated respectively from the first light-emitting elements 121 and the second light-emitting elements 122 are radiated respectively from a plurality of the light-emitting portions 120 in a state of being controlled in color unevenness.

In this configuration, the light-emitting circuit 100 of the embodiment is capable of controlling the luminous intensity distribution of the light-emitting portions 120, and also capable of reducing the probability of occurrence of the color unevenness of the irradiated light. Specifically, the light-emitting circuit 100 radiates white light obtained by combining the irradiated light from the first light-emitting elements 121, the irradiated light from the second light-emitting elements 122, and the irradiated light of phosphor contained in the color mixing unit 125 in a state of being reduced in color unevenness. When the color mixing unit 125 includes a scattering material, the light-emitting circuit 100 is capable of radiating the white light in a state in which the color unevenness is further reduced.

As a configuration of the light-emitting circuit 100 in which the LED chips are provided, which is the light-emitting circuit 100 radiating white light, the following three configurations are principally exemplified.

In other words, in the first configuration, red LED chips, green LED chips, and blue LED chips are provided on the substrate 110.

In the second configuration, the blue LED chips and phosphor that is excited by the irradiated light from the blue LED chips and radiates light having a longer wavelength than the wavelength area of the blue light (for example, YAG phosphor) are provided on the substrate 110. In this case, red phosphor may further be provided.

In the third configuration, an ultraviolet LED (UV-LED) chips and blue, green, red phosphor (BGR phosphor) are provided on the substrate 110.

In general, the light-emitting portions of the second configuration from among the first to the third configurations are widely brought into a practical use. Examples of a general system include a system in which a resin containing phosphor is flowed into a depressed frame provided with the blue LED chips, a reflector, and a frame. Examples also include a module formed with a resin layer containing phosphor on the substrate 110 so as to project from a reference surface thereof.

In the light-emitting circuit 100 provided with the LED chips, improvement of the quality of light such as color rendering properties comes to public attention as the improvement of the light amount and the improvement of the efficiency progress. As one of the methods of improvement of the color rendering properties, adding red and green phosphors is generally exemplified. However, the red phosphor absorbs the irradiated light from the yellow phosphor. Therefore, the light-emitting efficiency is lowered.

In contrast, in the light-emitting circuit 100 of the embodiment, the red LED chips (the second light-emitting elements 122) are sealed by the color mixing unit 125. The plurality of the light-emitting portions 120 are arranged apart from each other on the substrate 110, and the lights radiated respectively from the first light-emitting elements 121 and the second light-emitting elements 122 are radiated respectively from the plurality of light-emitting portions 120 in a state of being controlled in color unevenness. Accordingly, the color rendering properties may be improved while maintaining light-emitting efficiency.

In contrast, the luminous intensity distribution control is performed generally by combining the aggregated light source, and a reflector such as a mirror. However, when requiring a higher output, concentration of heat occurs in the aggregated light source. Consequently, the service life (for example, luminous flux, wire breakage, solder life) may not satisfy the predetermined reference. Therefore, the light-emitting circuit 100 is required to have performances which allow the luminous intensity distribution control and are suitable for the high-output.

In contrast, in the light-emitting circuit 100 of the embodiment, the luminous intensity distribution control member 150 in which the plurality of light-emitting portions 120 have a relationship of one-to-one correspondence with a plurality of the lenses is provided. In this configuration, the light-emitting circuit 100 has performances which allow the luminous intensity distribution control and are suitable for the high-output. Since the luminous intensity distribution control member 150 includes a plurality of the lenses, the luminous intensity distributions of the lights radiated respectively from a plurality of the light-emitting portions 120 may be controlled individually. In other words, the flexibility of the luminous intensity distribution control may be improved.

The plurality of the light-emitting portions 120 are arranged concentrically or pseudo-concentrically, and the lights radiated respectively from the first light-emitting elements 121 and the second light-emitting elements 122 are radiated in a state of being controlled in color unevenness. The arrangements of the first light-emitting elements 121 and the second light-emitting elements 122 in the interior of the color mixing unit 125 are the same in a plurality of the light-emitting portions 120 respectively. Therefore, color variations among a plurality of the light-emitting portions 120 may be reduced. In other words, there is a case where the color variations may occur depending on the angle of viewing the light-emitting portions 120, while the degrees of the color variations among a plurality of the light-emitting portions 120 are substantially the same in any angle when the light-emitting portions 120 are viewed from the same angles.

The phosphor that the color mixing unit 125 contains may be added with an additive. In this configuration, the light-emitting portions 120 is capable of combining the irradiated light from the first light-emitting elements 121, the irradiated light from the second light-emitting elements 122, and the irradiated light of phosphor contained in the color mixing unit 125 further reliably and radiating in a state of being further reduced in color unevenness.

Figure 3A:
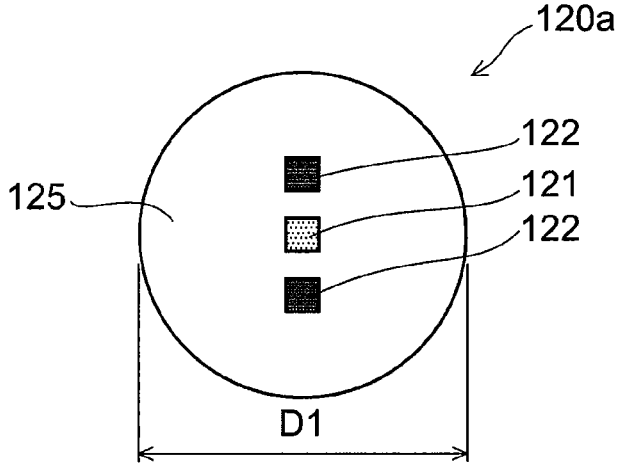
FIGS. 3A to 3C are schematic plan views illustrating arrangements of first light-emitting elements and second light-emitting elements of the embodiment.
Figure 3B:
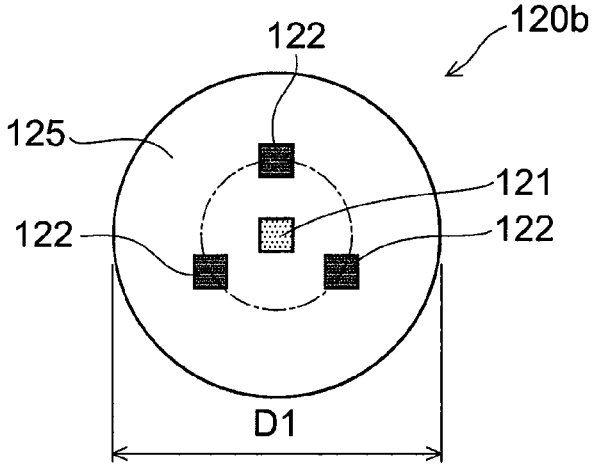
Figure 3C:
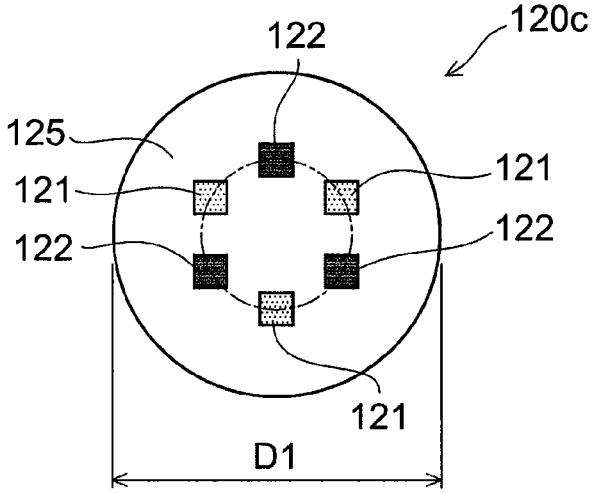

FIGS. 3A to 3C are schematic plan views illustrating arrangements of first light-emitting elements and second light-emitting elements of the embodiment.

FIGS. 3A to 3C are schematic plan views schematically illustrating the light-emitting portions when viewing in the vertical direction with respect to the main surface of the substrate 110.

Light-emitting portions 120*a* illustrated in FIG. 3A include one of the first light-emitting elements 121 and two of the second light-emitting elements 122. When viewing the substrate 110 vertically with respect to the main surface thereof, the first light-emitting element 121 is provided at a substantially center of the color mixing unit 125. When viewing the substrate 110 vertically with respect to the main surface, the two second light-emitting elements 122 are provided at both sides of the first light-emitting element 121. In other words, the first light-emitting element 121 is provided between the two second light-emitting elements 122. The one first light-emitting element 121 and the two second light-emitting elements 122 are provided on a substantially same line.

The diameter D1 of the color mixing unit 125 is, for example, approximately 4.5 millimeter (mm) to 12 mm.

Light-emitting portions 120*b* illustrated in FIG. 3B include one of the first light-emitting elements 121 and three of the second light-emitting elements 122. When viewing the substrate 110 vertically with respect to the main surface thereof, the first light-emitting elements 121 are provided at a substantially center of the color mixing unit 125. When viewing the substrate 110 vertically with respect to the main surface thereof, the three second light-emitting elements 122 surround the first light-emitting element 121. At least parts of the respective three second light-emitting elements 122 exist on a circle having a predetermined diameter. When the centers of the three second light-emitting elements 122 are connected by the straight lines, the outline becomes a substantially regular triangle. The first light-emitting element 121 is arranged at a substantially center of gravity of the substantially regular triangle formed by connecting the centers of the three second light-emitting elements 122 with straight lines.

Light-emitting portions 120*c* illustrated in FIG. 3C include three of the first light-emitting elements 121 and three of the second light-emitting elements 122. When viewing the substrate 110 vertically with respect to the main surface thereof, at least parts of the three first light-emitting elements 121 and the three second light-emitting elements 122 exist on the circle having a predetermined diameter. The first light-emitting elements 121 and the second light-emitting elements 122 are provided alternately on the circle having the predetermined diameter. When the centers of the three first light-emitting elements 121 are connected by the straight lines, the outline becomes a substantially regular triangle. When the centers of the three second light-emitting elements 121 are connected by the straight lines, the outline becomes a substantially regular triangle.

By changing the arrangement or the number of installation of the first light-emitting elements 121 and the second light-emitting elements 122 as the light-emitting portions 120*a*, 120*b*, and 120*c* illustrated in FIGS. 3A to 3C, light having various color temperatures or various outputs may be formed. By setting the driving voltage of the first light-emitting elements 121 and the driving voltage of the second light-emitting elements 122 respectively as needed or by setting the system of the first light-emitting elements 121 and the second light-emitting elements 122 as needed, color may be changed in the single light-emitting circuit 100.

The arrangements of the first light-emitting elements 121 and the second light-emitting elements 122 are not limited to the arrangements illustrated in FIGS. 3A to 3C.

Subsequently, the concrete example of the luminous intensity distribution control member of the embodiment will be described with reference to the drawings.

Figure 4A:
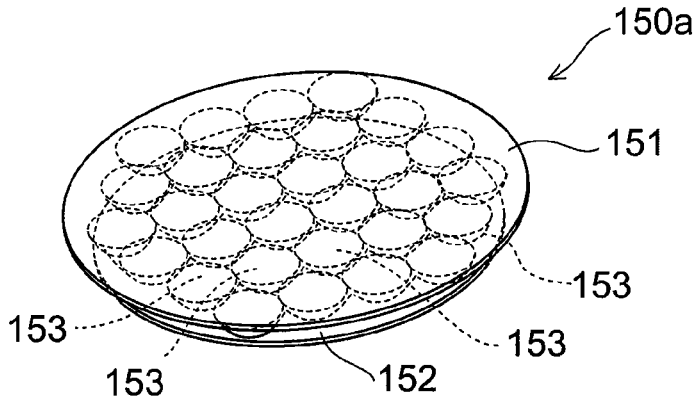
FIGS. 4A to 4C are schematic drawings illustrating concrete example of a luminous intensity distribution control member of the embodiment.
Figure 4B:
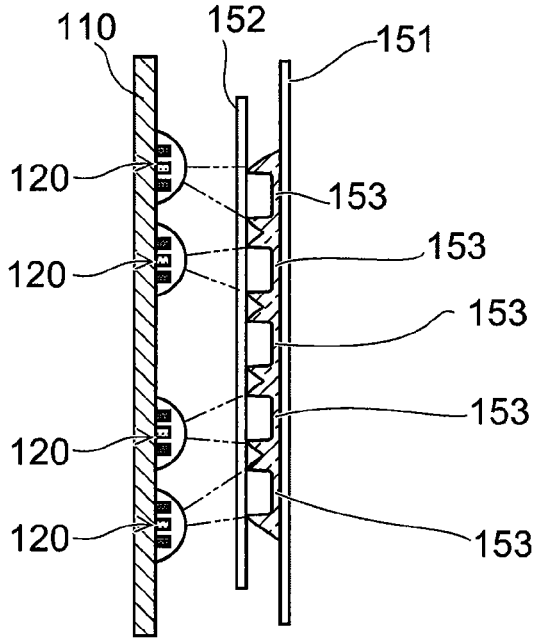
Figure 4C:
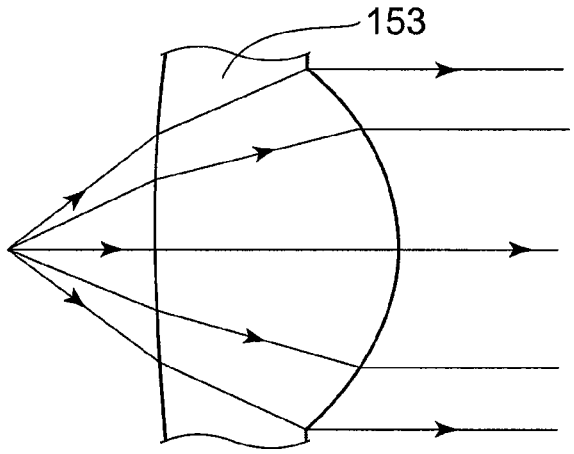

FIGS. 4A to 4C are schematic drawings illustrating a concrete example of the luminous intensity distribution control member of the embodiment.

FIG. 4A is a schematic perspective view illustrating the luminous intensity distribution control member of the concrete example. FIG. 4B is a schematic cross-sectional view illustrating the light-emitting circuit having the luminous intensity distribution control member of the concrete example. FIG. 4C is a schematic cross-sectional view illustrating the lenses having the luminous intensity distribution control member of the concrete example. FIGS. 4B and 4C correspond to schematic cross-sectional views taken along the section A-A in FIG. 1A.

As illustrated in FIG. 4A, a luminous intensity distribution control member 150*a* of the concrete example includes a first supporting member 151, a second supporting member 152, and collimator lenses 153. The collimator lenses 153 are sandwiched between the first supporting member 151 and the second supporting member 152. In the luminous intensity distribution control member 150*a* of the concrete example, a plurality of the collimator lenses 153 are provided. As illustrated in FIG. 4C, the collimator lenses 153 convert light into parallel light beams. The collimator lenses 153 are used when adjusting the focus position, for example.

A plurality of the collimator lenses 153 are provided corresponding to a plurality of the light-emitting portions 120. In other words, as illustrated in FIG. 4B, light radiated from one of the light-emitting portions 120 enters one of a plurality of the collimator lenses 153. In other words, a plurality of the light-emitting portions 120 and a plurality of the collimator lenses 153 have a relationship of one-to-one correspondence respectively.

Figure 5A:
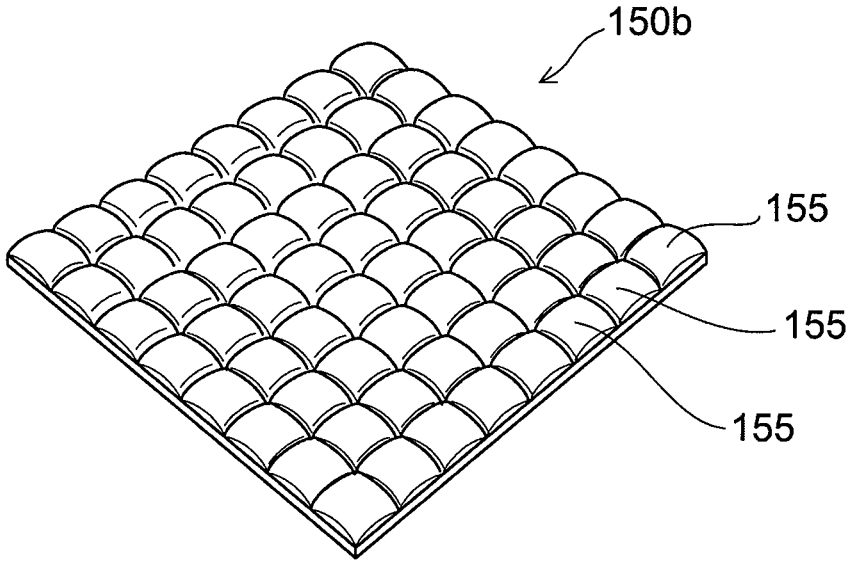
FIGS. 5A and 5B are schematic drawings illustrating another concrete example of a luminous intensity distribution control member of the embodiment.
Figure 5B:
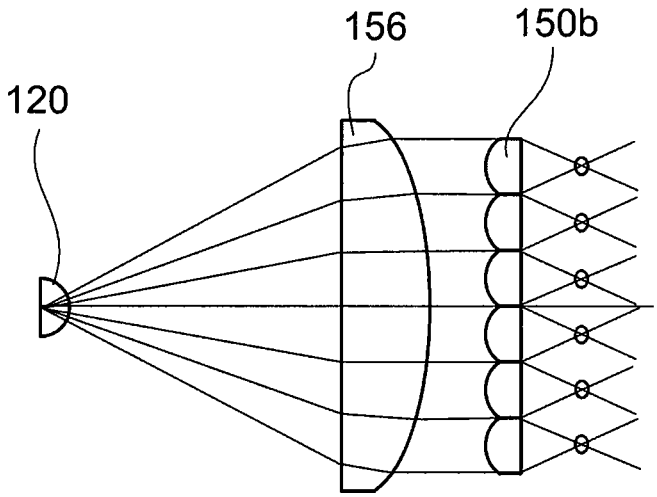

FIGS. 5A and 5B are schematic drawings illustrating another concrete example of a luminous intensity distribution control member of the embodiment.

FIG. 5A is a schematic perspective views illustrating the luminous intensity distribution control member of the concrete example. FIG. 5B is a schematic cross-sectional view illustrating a relationship between the light-emitting portions and the luminous intensity distribution control member of the concrete example. FIG. 5B corresponds to a schematic cross-sectional view taken along the section A-A expressed in FIG. 1A.

As illustrated in FIG. 5A, a luminous intensity distribution control member 150*b* of the concrete example is a so called fly-eye lens (integrator lens) in which a plurality of the same single lenses 155 are arranged in the vertical and horizontal directions. As illustrated in FIG. 5B, the luminous intensity distribution control member 150*b* of the concrete example generates multiple images by the number of the single lenses 155 which constitute the array. When the light-emitting portions 120 are as small as those which can be handled as spot light sources, the luminous intensity distribution control member 150*b* is capable of forming a number of spot light sources.

A plurality of the single lenses 155 are provided corresponding to a plurality of the light-emitting portions 120. In other words, light radiated from one of the light-emitting portions 120 enters one of a plurality of the single lenses 155. In other words, a plurality of the light-emitting portions 120 and a plurality of the single lenses 155 have a relationship of one-to-one correspondence.

As illustrated in FIG. 5B, the collimator lens 156 may be provided between the light-emitting portions 120 and the luminous intensity distribution control member 150*b*.

According to the concrete example, the light-emitting circuit 100 is capable of radiating light in a state in which the light intensity unevenness is reduced.

FIGS. 6A and 6B are schematic drawings illustrating still another concrete example of a luminous intensity distribution control member of the embodiment.

FIG. 6A is a schematic cross-sectional view illustrating a lens of a comparative example. FIG. 6B is a schematic cross-sectional view illustrating the lenses having the luminous intensity distribution control member of the concrete example. FIGS. 6A and 6B correspond to a schematic cross-sectional views taken along the line A-A in FIG. 1A.

As illustrated in FIG. 6B, the luminous intensity distribution control member 150*c* of this concrete example includes a so-called Fresnel lens 158 formed by dividing normal lens 159 illustrated in FIG. 6A, for example, into concentric areas and reducing the thickness. The Fresnel lens 158 has, for example, a saw-like cross section, and the thickness is reduced with increase of the number of divisions.

The luminous intensity distribution control member 150*c* of the concrete example has a plurality of Fresnel lenses 158. Like the luminous intensity distribution control member 150*a* described above in conjunction with FIG. 4A and the luminous intensity distribution control member 150*b* described above in conjunction with FIG. 5A, a plurality of the Fresnel lenses 158 are arranged, for example, on a flat surface.

A plurality of the Fresnel lenses 158 are provided corresponding to a plurality of the light-emitting portions 120. In other words, light radiated from one of the light-emitting portions 120 enters one of a plurality of the Fresnel lenses 158. In other words, a plurality of the light-emitting portions 120 and a plurality of the Fresnel lenses 158 have a relationship of one-to-one correspondence.

FIG. 7 is a schematic cross-sectional view illustrating a light-emitting circuit according to another embodiment.

FIG. 7 corresponds to a schematic cross-sectional view taken along the section A-A expressed in FIG. 1A.

A light-emitting circuit 100*a* according to the embodiment further includes a light-diffuser layer 160 in comparison with the light-emitting circuit 100 described above in conjunction with FIGS. 1A and 1B. The light-diffuser layer 160 is provided between the light-emitting portions 120 and the luminous intensity distribution control member 150.

For example, the light-diffuser layer 160 contains oxide particles, not illustrated. The light-diffuser layer 160 is formed by applying dispersion liquid which is aqueous binder including oxide particles dispersed therein is applied on the surface of the luminous intensity distribution control member 150 by spraying and then sintered. The light-diffuser layer 160 may be formed by applying dispersion liquid which is organic solvent including oxide particles dispersed therein is applied on the surface of the luminous intensity distribution control member 150. The thickness of the light-diffuser layer 160 is on the order of approximately several micrometers (μm) to several tens of μm for example.

The lights radiated respectively from the first light-emitting elements 121 and the second light-emitting elements 122 are radiated from the plurality of light-emitting portions 120 in a state of being controlled in color unevenness and enters the light-diffuser layer 160. The light entering the light-diffuser layer 160 is diffused by the light-diffuser layer 160, passes through the luminous intensity distribution control member 150, and is radiated to the outside of the light-emitting circuit 100*a*.

Accordingly, the light-emitting circuit 100*a* of the embodiment may be radiated in a state in which the color unevenness is further reduced.

When the light-diffuser layer 160 has the oxide particles, the deterioration due to the incident light can hardly occur. In other words, the light-diffuser layer 160 having oxide particles resists the deterioration with time, and is capable of dispersing light during the service life of the LED chips (the first light-emitting elements 121 and the second light-emitting elements 122). Accordingly, the light-emitting circuit 100*a* of the embodiment may be radiated in a state in which the color unevenness is further reduced during the service life of the light-emitting circuit 100*a* itself.

Subsequently, another embodiments disclosed herein will be described with reference to the drawings.

Figure 8:
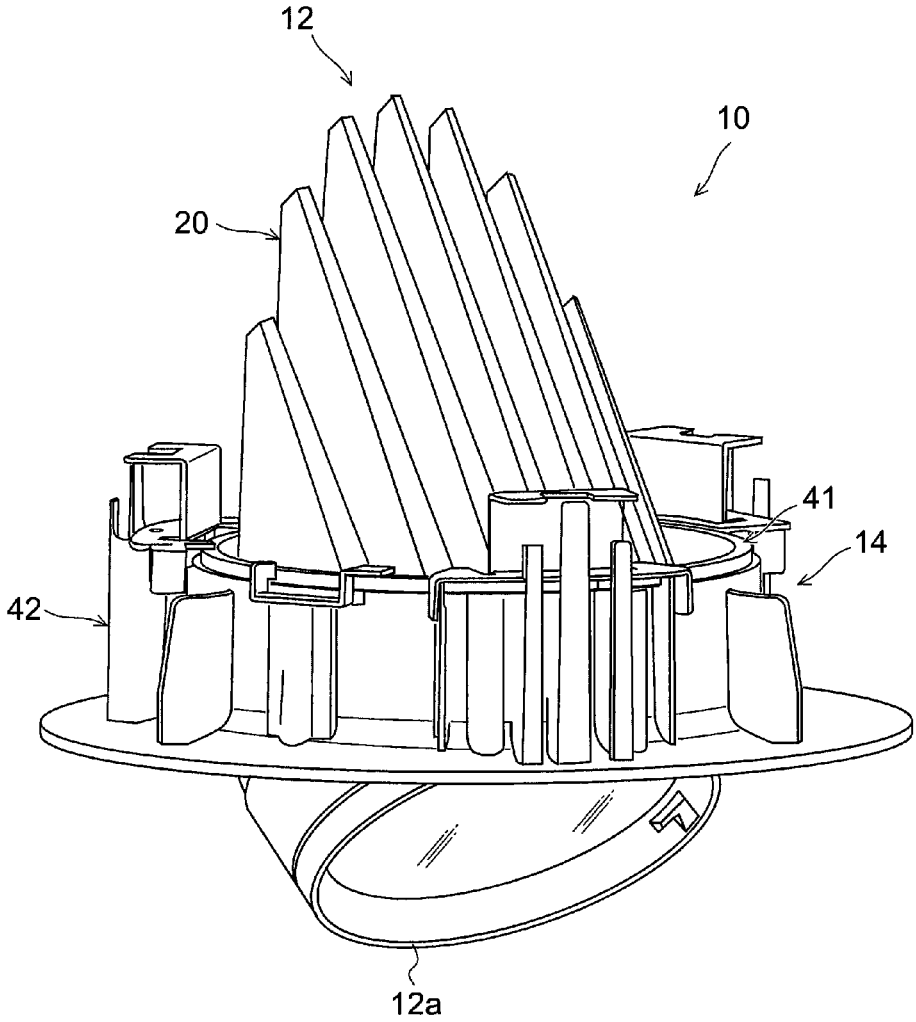
FIG. 8 is schematic perspective view illustrating a luminaire according to the embodiment.

FIG. 8 is schematic cross-sectional view illustrating a luminaire according to the embodiment.

Figure 9:
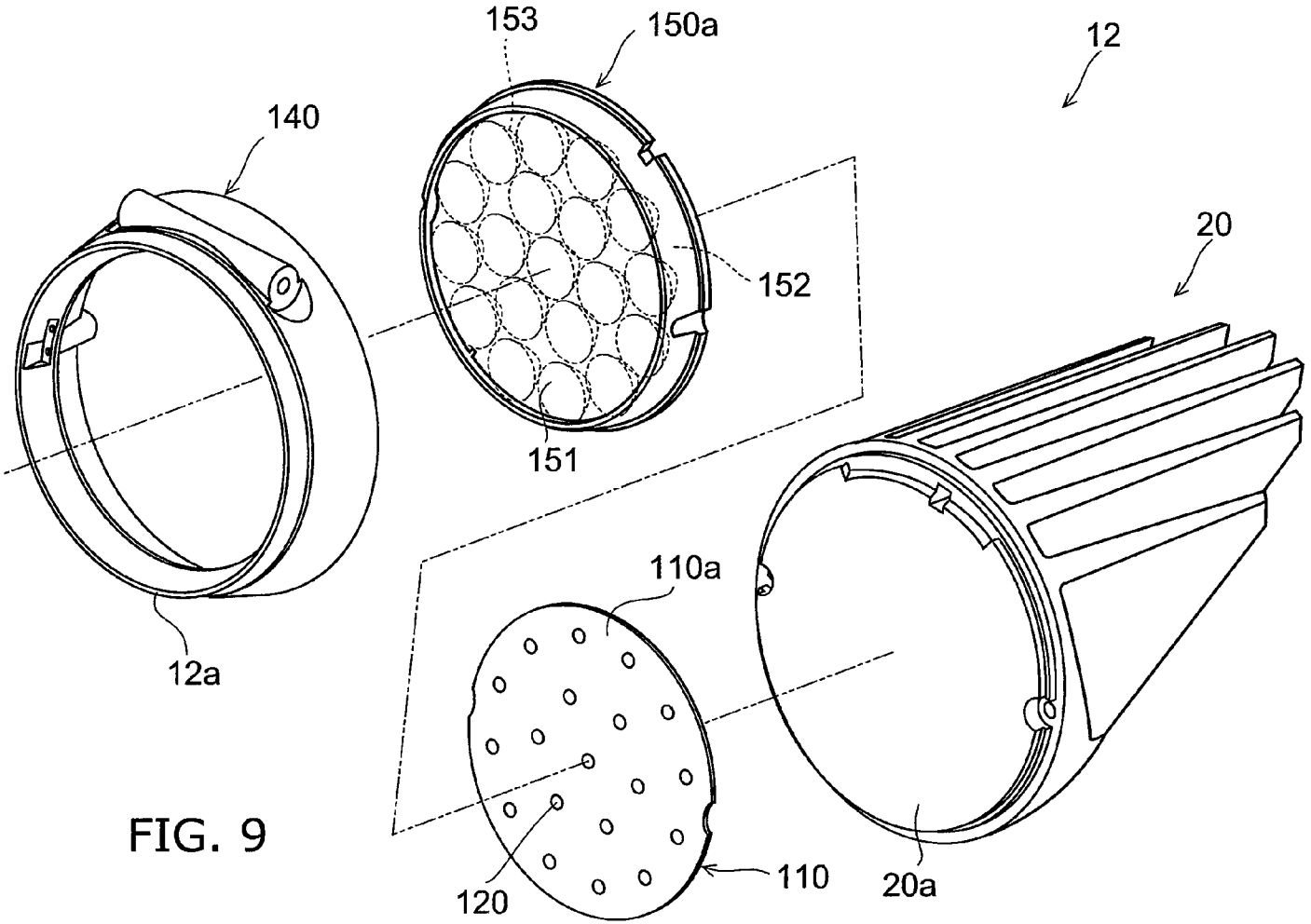
FIG. 9 is a schematic exploded view illustrating a luminaire body of the embodiment.

FIG. 9 is a schematic exploded view illustrating a luminaire body of the embodiment.

As illustrated in FIG. 8, a luminaire 10 of the embodiment includes a luminaire body 12 and a supporting portion 14. As illustrated in FIG. 9, the luminaire body 12 includes the light-emitting circuit 100 described above in conjunction with FIGS. 1A and 1B, or the light-emitting circuit 100*a* described above in conjunction with FIG. 7 and radiates light toward an object. In the following description, a case where the luminaire body 12 includes the light-emitting circuit 100 described above in conjunction with FIGS. 1A and 1B will be described as an example for the sake of convenience of luminaire body. The light-emitting circuit 100 will be described by exemplifying a case of including the luminous intensity distribution control member 150*a* described above in conjunction with FIGS. 4A to 4C.

The luminaire body 12 includes an irradiating window 12*a* configured to let light radiated from the light-emitting portions 120 (hereinafter, referred to as "irradiated light") to out therefrom. The irradiated light is emitted to the outside of the luminaire body 12 via the irradiating window 12*a*. Accordingly, the object is irradiated with the irradiated light.

The luminaire body 12 includes the light-emitting circuit 100 and a thermal radiator 20. The thermal radiator 20 radiates heat generated in association with light-emission of the light-emitting circuit 100, for example. The thermal radiator 20 is formed of, for example, a metallic material having a relatively high coefficient of thermal conductivity such as aluminum. In the luminaire 10 of the embodiment, the holding member 140 of the light-emitting circuit 100 holds the thermal radiator 20 and the luminous intensity distribution control member 150*a*. The holding member 140 has, for example, a cylindrical shape. In this example, the holding member 140 has a cylindrical shape. In this example, one end of the holding member 140 corresponds to the irradiating window 12*a*. The thermal radiator 20 is mounted to the other end of the holding member 140. In other words, the thermal radiator 20 is provided on the side opposite to the irradiating window 12*a*.

The supporting portion 14 supports the luminaire body 12 and is used for mounting the luminaire 10 on the mounting object such as a ceiling panel. The luminaire 10 is mounted on the ceiling panel in a state in which the irradiating window 12*a* is faced downward, for example. The luminaire 10 is embedded into a recess provided in the ceiling panel, for example. In other words, the luminaire 10 is used as a so-called down light. In the following description, the luminaire 10 will be described while being used as a down light as an example. However, the mounting object of the luminaire 10 is not limited to the ceiling panel, and may be an inner wall panel, for example. Also, for example, the luminaire 10 is mounted on a specific mounting jig, and the luminaire 10 may be mounted on the ceiling or the like via the mounting jig. In other words, the mounting object of the luminaire 10 may be the mounting jig.

The supporting portion 14 includes a first frame member 41, and a second frame member 42. The first frame member 41 and the second frame member 42 are cylindrical members. In this example, the first frame member 41 and the second frame member 42 have a cylindrical shape. The supporting portion 14 supports the luminaire body 12 so as to be rotatable in a state of being inserted through the first frame member 41. The first frame member 41 supports the inserted luminaire body 12 so as to be rotatable. In this example, the first frame member 41 supports the holding member 140 so as to be rotatable. The first frame member 41 and the second frame member 42 are not limited to the cylindrical shape, and may be a given cylindrical shape such as a square cylindrical shape.

The thermal radiator 20 is provided with a mounting surface 20*a* for mounting the substrate 110. The surface area of the mounting surface 20*a* is substantially the same as the surface area of a surface 110*a* of the substrate 110. Alternatively, the surface area of the mounting surface 20*a* is slightly larger than the surface area of the surface 110*a* of the substrate 110. The substrate 110 is adhered to the mounting surface 20*a* of the thermal radiator 20 via the thermal radiating sheet, for example. Accordingly, the substrate 110 is held by the thermal radiator 20. For example, heat generated in association with the light-emission of the respective light-emitting portions 120 is radiated by the thermal radiator 20. For example, an influence of the heat on the respective light-emitting portions 120 may be reduced.

In this example, the substrate 110 is adhered to the thermal radiator 20. However, the substrate 110 or the light-emitting portions 120 may be demountably mounted on the thermal radiator 20, for example. The light-emitting portions 120 may be configured to be replaceable with respect to the luminaire 10.

Subsequently, an example of the result of study conducted by the present inventor will be described with reference to the drawings.

FIG. 10 is a table showing an example of a result of study conducted by the inventor.

The substrate 110 formed of a material containing at least one of glass epoxy, metal or ceramic was used. When the substrate 110 was formed of a material containing ceramic, 96% alumina substrate was used. The wiring layer was formed of nickel (Ni) plating, palladium (Pd) plating, or gold (Au) plating. At this time, the nickel plating, the palladium plating, and the gold plating were applied on a silver printing.

The diameter D1 of the color mixing unit 125 was approximately 3.5 millimeter (mm) to 5.5 mm. Since the color breakup may be generated on the basis of the arrangement of the LED chips, the color temperature of light radiated from the light-emitting portions 120 was defined to be 3000 Kelvin (K) and the mean color rendering evaluating value was defined to be Ra85. As the luminous intensity distribution control member 150, the one having the collimator lenses was used. The conditions of other LED chips or phosphors were as shown in FIG. 10. The "aggregation" from among the "the states of installation of the light-emitting portion" was a state of installation in which a single light-emitting portions 120, instead of a plural, was provided on the substrate 110 and the LED chips were sealed by a relatively large one phosphor. The "arrangement apart from each other" from among the "states of installation of the light-emitting portion" illustrated in FIG. 10 meant the state of installation in which a plurality of the light-emitting portions 120 were arranged on the substrate 110 so as to be apart from each other.

Under such conditions, the light-emitting circuit 100 was inserted into the down light or in the base light instrument and the evaluation was conducted. As an evaluation, lowering of the luminous flux and color changes due to the influence of heat were investigated. The color breakup was investigated as a visual evaluation. An example of the result of evaluation was as shown in FIG. 10. According to the evaluation, the "arrangement apart from each other" was employed as the state of installation of the light-emitting portions 120 when increasing the output, and the first arrangement to the third arrangement were employed as the state of installation of the LED chips, so that the light-emitting circuit 100 having high-efficiency, high color rendering properties, and less color breakup was obtained.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A light-emitting circuit comprising:

a substrate;

a plurality of light-emitting portions arranged apart from each other on the substrate, each of a plurality of the light-emitting portions including a plurality of light-emitting elements configured to radiate light and a color mixing unit sealing the plurality of the light-emitting elements and configured to combine lights radiated from the plurality of the light-emitting elements; and a luminous intensity distribution control member including a plurality of lenses provided corresponding to the plurality of the light-emitting portions, respectively, provided so that respective lights radiated from the plurality of the light-emitting portions enter the plurality of the lenses respectively, and configured to change luminous intensity distribution of the light-emitting portions, each of the color mixing units having a dome shape, the plurality of light-emitting elements of each of the light-emitting portions including a first light-emitting element configured to radiate light in a first wavelength range and a plurality of second light-emitting elements configured to radiate light in a second wavelength range that does not overlap with the first wavelength range, the first light-emitting element and the plurality of second light-emitting elements of each of the light-emitting portions being sealed with the same color mixing unit, and the plurality of second light-emitting elements surrounding the first light-emitting element and arranged in a circular shape.

2. The circuit according to claim 1, wherein the light-emitting elements are semiconductor light-emitting elements containing a semiconductor material.

3. The circuit according to claim 1, wherein each of the first light-emitting elements radiates blue light having a peak wavelength between 430 nanometers and 490 nanometers, and each of the second light-emitting elements radiates red light having a peak wavelength between 600 nanometers and 670 nanometers.

4. The circuit according to claim 1, wherein each of the color mixing units includes a phosphor configured to be excited by irradiation of light from the first light-emitting element and radiate light in a third wavelength range different from the first wavelength range, and a scattering material, and each of the light-emitting portions radiates light including light radiated from the first light-emitting element, light radiated from the second light-emitting element, and light radiated from the phosphor combined together.

5. The circuit according to claim 4, wherein the phosphor is a yellow phosphor configured to be excited by the light radiated from the first light-emitting element, and radiate light having a wavelength longer than 490 nanometers.

6. The circuit according to claim 1, wherein the arrangement of the plurality of the light-emitting elements in the interior of the corresponding color mixing unit is the same for each of a plurality of the light-emitting portions.

7. The circuit according to claim 1, wherein the horizontal and vertical ratio of the aggregation of the plurality of the light-emitting portions on the substrate is 10:1 or more and 1:1 or lower.

8. The circuit according to claim 1, wherein the plurality of the light-emitting portions are arranged concentrically or pseudo-concentrically on the substrate.

9. The circuit according to claim 1, wherein the plurality of the light-emitting portions are arranged linearly on the substrate.

10. The circuit according to claim 1, wherein each of the plurality of the light-emitting portions is formed into a dome shape on the substrate.

11. The circuit according to claim 1, further comprising a light-diffuser layer provided between the light-emitting portions and the luminous intensity distribution control member.

12. The circuit according to claim 1, wherein each of the lenses is a collimator lens.

13. The circuit according to claim 1, wherein the luminous intensity distribution control member includes a fly-eye lens including a plurality of the lenses arranged vertically and horizontally.

14. The circuit according to claim 1, wherein each of the lenses is a Fresnel lens.

15. A luminaire comprising the light-emitting circuit according to claim 1.

* * * * *